United States Patent [19]

Parrish

[11] Patent Number: 4,874,911

[45] Date of Patent: Oct. 17, 1989

[54] ELECTRICAL REVERSING SWITCH

[75] Inventor: Timothy L. Parrish, Kenly, N.C.

[73] Assignee: Eaton Corporation, Cleveland, Ohio

[21] Appl. No.: 173,893

[22] Filed: Mar. 28, 1988

[51] Int. Cl.[4] ..... H01H 9/00

[52] U.S. Cl. ..... 200/6 R; 200/6 B; 200/144 R; 200/275; 200/284; 200/431; 200/437

[58] Field of Search ..... 200/144 R, 6 R, 6 B, 200/225, 284, 431, 437

[56] References Cited

U.S. PATENT DOCUMENTS 4,683,352 7/1987 Yano et al. ..... 200/6 R

*Primary Examiner*—Robert S. Macon

*Attorney, Agent, or Firm*—L. G. Vande Zande

[57] ABSTRACT

A double pole, double throw rocking contactor switch is operable as a reversing switch by particularly configured stationary contacts at the corresponding ends of the respective poles. Stationary contacts are formed electrically common out of a single member having the stationary contact of one pole formed to be disposed below the rocking contactor and the stationary contact of the other pole formed to be disposed above its respective contactor. Accordingly, one contactor engages the upper surface of a stationary contact while the other end of the other contactor engages the under surface of the opposite stationary contact for a given stable position of the actuator, thereby causing the respective contactors to engage stationary contacts at respective opposite ends of the contactors, accomplishing the reversing function internally of the switch without special cross connect conductors, thereby permitting press-in wire terminations to be utilized. The stationary contacts are provided with serrations which cooperate with the leaf spring wire retainers to provide improved press-in wire terminations.

8 Claims, 4 Drawing Sheets

2b
2
2a
34
32
32b
32a
32b
32d
32c
32d
20c
20a
20b
20
10
10a
38
36
12b
12
12d
12a
12c
30
30a
30a
28
28a
28a
22
24
10b
10d
10a
10
10e
10c
14a
14
4j
4b
4h
4
4f
8
4c
6
4d
18c
18b
18a
18
4k
4a
4g
4e
4p

ELECTRICAL REVERSING SWITCH

BACKGROUND OF THE INVENTION

This invention relates to electrical reversing switches which upon actuation from one condition to another change the direction of current flow through the switch.

Electrical reversing switches are commonly double pole, double throw switches which have their load side terminals cross connected by external jumper wires. This configuration results in a bulky wiring structure at the terminals of the switch. Additionally, switches which have internal press-in wire terminations effected by inserting the bared ends of wire conductors into holes in the housing of the switch do not readily lend themselves to such external jumper cross connections. U.S. Pat. No. 4,683,352 issued July 28, 1987 to Takashi Yano and Yasuo Yoneyama discloses a reversing switch having press-in terminations wherein the cross connection between the load side terminals is accomplished internally of the switch housing. This switch comprises a double pole, double throw toggle mechanism wherein rocking contactors are pivotally supported on a common central contact, the ends of the contactors being pivoted downward into engagement with stationary contacts at one end of each pole of the switch in one position and pivoted downward at the opposite end into engagement with stationary contacts at the other end of each pole of the switch in a second position. Cross connection jumpers are molded integrally within a base member of the switch and are connected to the stationary contacts at the respective ends of each pole. While this switch is useful for its intended purpose, the present invention relates to improvements thereover.

SUMMARY OF THE INVENTION

The present invention provides a reversing switch which is readily and economically manufactured. It comprises a double pole, double throw rocking contactor switch which is actuated by a pivotally mounted actuator which may be operated by a toggle lever or a rocker button. One pole of the switch contains the customary center fulcrum contact on which a rocker contactor is pivotally supported and a pair of stationary contacts located on opposite sides of the fulcrum contact for engagement on their upper surface by the rocking contactor. The other pole of the switch of this invention is substantially the same as the above described pole except it has the stationary contacts spaced above the rocking contactor for engagement at their under surfaces by the upper surface of the rocking contactor. This arrangement provides engagement by the respective rocking contactor with stationary contacts at opposite ends of the two poles in either position of the pivotal actuator. The stationary contacts at corresponding ends of the two poles are formed from common electrically conductive members which have press-in wire termination members associated therewith forming output terminations at the load side of the switch. The invention also provides serrations on a surface of the stationary contact conductive members and the fulcrum contacts for enhancing the press-in wire termination with the respective contact.

The features and advantages of this invention will become more readily apparent when reading the following specification and claims in conjunction with the accompanying drawings.

DESCRIPTION OF THE PREFERRED EMBODIMENT

Figure 1:
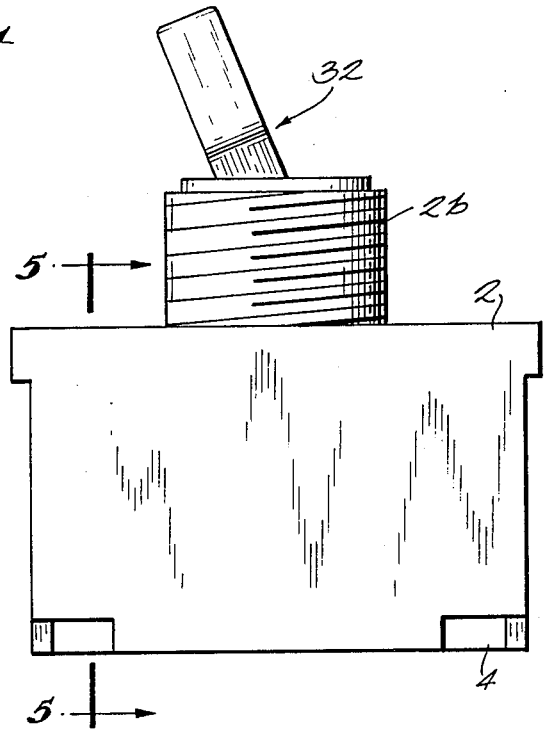
FIG. 1 is a side elevational view of the electrical reversing switch of this invention.
Figure 2:
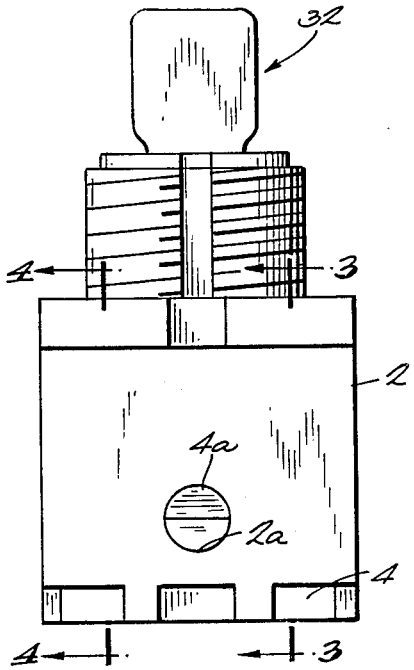
FIG. 2 is a right end elevational view of the switch of FIG. 1.
Figure 6:
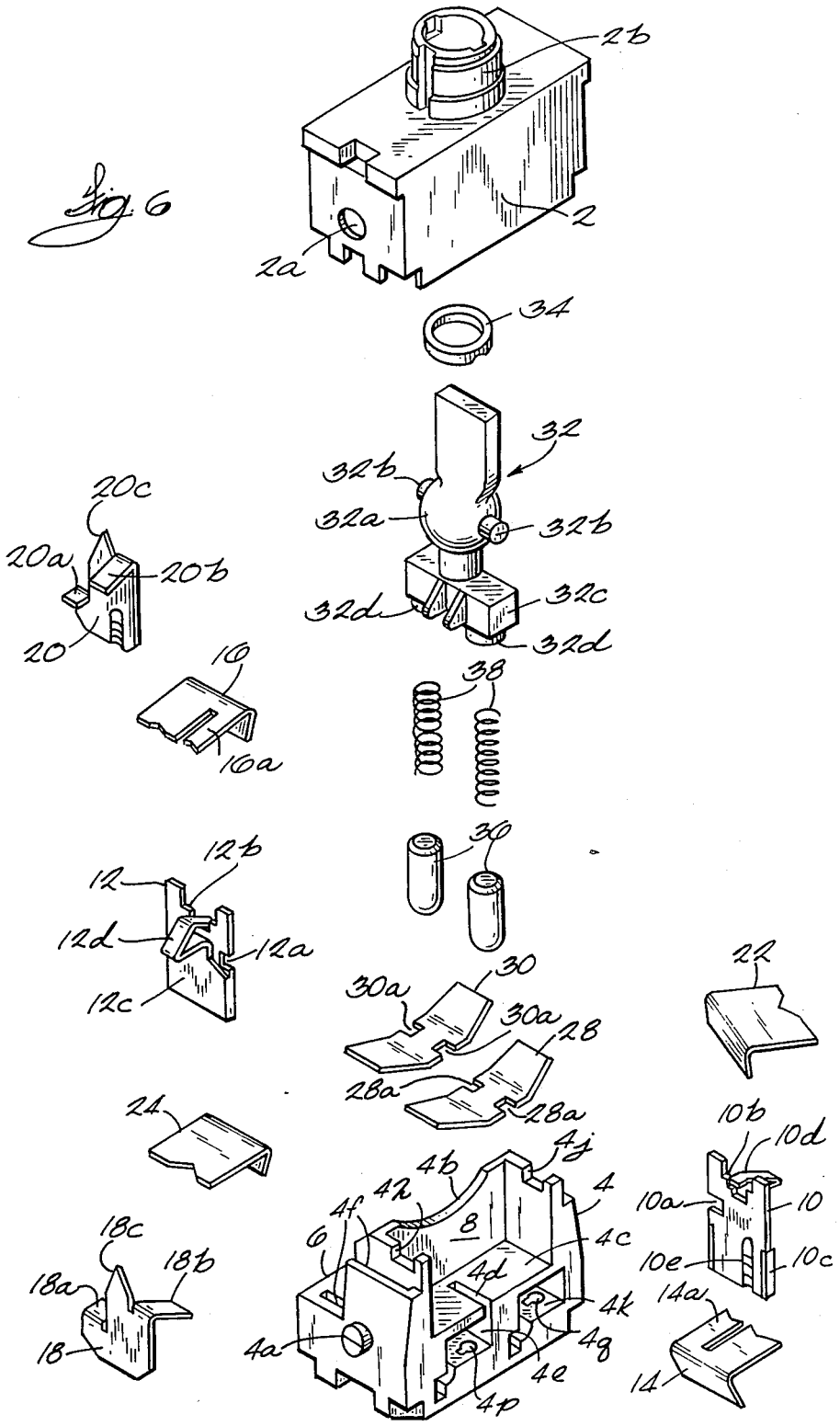
FIG. 6 is an exploded isometric view of the switch of FIGS. 1-5.

Referring to the drawings and particularly to FIGS. 1, 2 and 6 thereof, the switch of this invention is a double pole, double throw toggle switch having an insulating housing comprising a molded insulating cover 2 and molded insulating base 4. Cover 2 is telescopically disposed over base 4 and attached thereto with a snap fit by the interengagement of holes 2*a* (only one visible in FIGS. 2 and 6) in the end walls of cover 2 with beveled cylindrical projections 4*a* (only one visible in FIGS. 2 and 6) formed on the end walls of base 4. Base 4 has an upstanding central wall 4*b* extending longitudinally between the end walls thereof to divide the base and the housing into side-by-side switch pole compartments 6 and 8 when the cover 2 is attached to the base 4. The floor 4*c* of compartment 8 is provided with a slot 4*d* open to one side of base 4 and communicating with a rectangular pocket 4*e* in the lower portion of base 4 which is also open to the side of the base 4. A fulcrum contact assembly 10 is received within the slot 4*d* and the pocket 4*e*. Contact assembly 10 has a notch 10*a* along one edge which interlocks with a portion of floor 4*c* adjacent the end of slot 4*d* to position contact assembly 10 in an upright manner within the compartment 8. Although not visible in FIG. 6, the floor of compartment 6 is provided with a slot similar to 4*d* open to the opposite side of base 4 for receiving a fulcrum contact assembly 12 having a notch 12*a* formed in one edge thereof. Fulcrum contacts 10 and 12 have stepped recesses in their upper edges which provide pivot surfaces 10*b* and 12*b*, respectively, for rocking contactors and a clearance space for a spring contact 10*c* and 12*c*, repsecitively. The spring contacts 10*c* and 12*c* are attached to a vertical surface of the fulcrum contact by spot welding or the like and are formed at their upper ends to have an inverted V-shaped spring member 10*d* and 12*d*, respectively, disposed within the deepest part of the recess to engage the underside of a rocking contactor when assembled thereto. A bifurcated leaf spring wire retainer 14 is inserted into pocket 4*e* to cooperate with fulcrum contact 10 in retaining a wire conductor in electrical engagement with contact 10 as will be more fully described hereinafter. Similarly, a bifurcated leaf spring contact 16 is inserted into a pocket in the opposite side of base 4 which corresponds to pocket 4*e* to cooperate with fulcrum contact 12 in the same manner.

Figure 5:
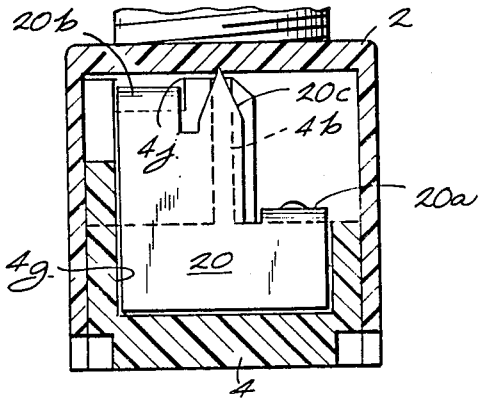
FIG. 5 is a transverse cross sectional view taken generally along the line 5—5 of FIG. 1 showing an electrically conductive member containing one pair of stationary contacts for the two poles of the switch of this invention.

The opposite end walls of base 4 have upwardly opening slots 4*f* and 4*g* formed therein (only slot 4*f* is visible in FIG. 6). These slots receive stationary contact members 18 and 20, respectively. Contact 20 is formed as a mirror image of contact 18. The stationary contacts comprise main body portions which have a first formed over projection 18*a*, 20*a* extending at substantially right angles to the main body portion. A second formed over projection 18*b*, 20*b*, extends at an acute angle from the main body portion. It will be observed that the bend forming projections 18*b*, 20*b* is located substantially higher on the main body portion than the bend forming projections 18*a*, 20*a*. Each stationary contact member also includes an upstanding pointed barb 18*c*, 20*c* disposed between the formed over projections of the respective stationary contact members. These contact members 18 and 20 are inserted into slots 4*f* and 4*g*, respectively, from the upper side of base 4 such that the main body portion of each contact is disposed within the slot and the projections extend toward each other within the compartments 6 and 8. The upper end walls of base 4 have recesses 4*h* and 4*j* adjacent compartment 8 to receive the projections 18*b*, 20*b*, respectively, as the latter extended toward each other into the compartment 8. The right angle projections 18*a*, 20*a* of the respective stationary contact members extend toward each other in compartment 6, and lie flat against the floor of that compartment. As seen in FIG. 5, barb 18*c*, not visible in FIG. 5, 20*c* extends above the upper surface of base 4 to pierce the upper wall of cover 2, thereby anchoring the upper ends of stationary contact members 18, 20 in position when the cover 2 is assembled to base 4.

A rectangular pocket 4*k* is formed in the lower portion of base 4 adjacent pocket 4*e* as seen in FIG. 6. Pocket 4*k* communicates with groove 4*g*, not shown in FIG. 6, in the end wall of base 4 and stationary contact member 20 extends through slot 4*g* into pocket 4*k*. A leaf spring wire retainer 22 similar to retainers 14 and 16, but not bifurcated, is inserted into pocket 4*k* to cooperate with the main body portion of stationary contact 20 for retaining a wire conductor inserted through an opening in the bottom of base 4 against the main body portion of stationary contact 20. Base 4 is provided with a corresponding pocket 4*m* (FIG. 4) on the opposite side thereof which communicates with groove 4*f*. Stationary contact member 18 extends through groove 4*f* into the pocket 4*m* and cooperates with a leaf spring wire retainer 24 which is inserted into the pocket 4*m* similarly to retainer 22.

A pair of wing shaped rocking contactors 28 and 30 are disposed on fulcrum contacts 10 and 12, respectively. The contactors have notches 28*a*, 30*a* formed in opposite lateral edges of the central portions thereof to locate the contactors within the recessed portions of the upper edges of the respective fulcrum contacts 10 and 12. The central web of the contactors between the notches 28*a*, 30*a*, respectively, rest upon the pivot surface 10*b*, 12*b*, respectively, of the fulcrum contacts to pivot about that surface. The apex of spring contacts 10*d*, 12*d* abuts the under surface of contactors 28, 30, respectively, when the contactors are positioned on the fulcrum contacts to enhance the commutation of current from the fulcrum contact to the rocking contactor. The outer ends of each rocking contactor 28 and 30 are formed angularly upward at a shallow angle. When so assembled to the fulcrum contacts, the contactor 30 is disposed above the stationary contacts 18*a*, 20*a* so that the opposite ends of the contactor can rock about the fulcrum contact 12 downwardly into alternate engagement with contact 18*a* or contact 20*a* (FIG. 4) and contactor 28 is disposed below the stationary contacts 18*b*, 20*b* so that when the contactor 28 is pivotally rocked about the fulcrum contact 10, the opposite ends thereof engage the under surfaces of stationary contacts 18*b*, 20*b*.

The switch assembly is completed by pivotally mounting an actuator assembly within the cover 2 of the insulating housing. A toggle lever actuator 32 has an intermediate ball portion 32*a* having trunions 32*b* extending laterally outwardly therefrom. Toggle lever 32 is inserted into a complementary ball socket within an upstanding cylindrical projection 2*b* formed on the top wall of cover 2. A rubber seal 34 is disposed over the upper portion of ball 32*a* prior to assembly to prevent the ingress of foreign materials into the switch through the open bushing 2*b*. The lower end of toggel actuator 32 is provided with a transverse cross bar 32*c* which has depending cylindrical bosses 32*d* at the lateral ends thereof. Although not specifically shown, the bosses 32*d* are provided with blind counterbores open to the bottom of actuator 32 to slidingly receive plungers 36 therein. The plungers 36 are hollow members and helical compression springs 38 are disposed within the plungers and the bores of cylindrical projections 32*d* to bias the plungers 36 outwardly of the actuator 32. The lower ends of plungers 36 are formed spherically.

Figure 3:
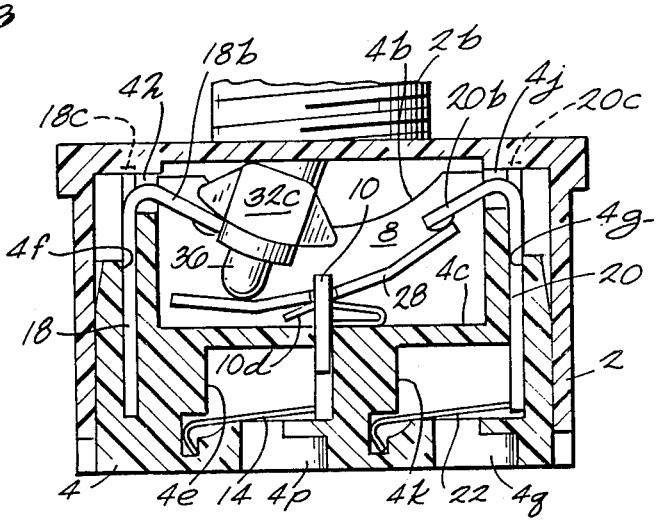
FIG. 3 is a cross sectional view through one pole of the electrical reversing switch of this invention taken generally along the line 3—3 in FIG. 2.
Figure 4:
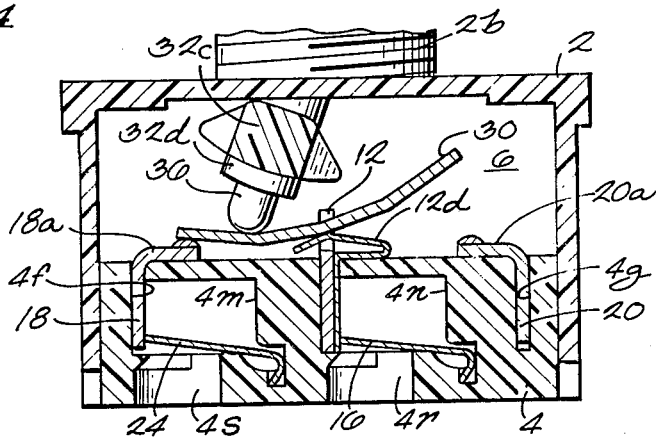
FIG. 4 is a cross sectional view through the other pole of the switch of this invention taken generally along the line 4—4 in FIG. 2.

When the cover 2 is assembled to the base 4, the lower ends of plungers 36 resiliently engage the upper surfaces of rocking contactors 28 and 30. In a well known manner, as toggle actuator 32 is pivoted about the pivot formed by trunions 32*b* within the bushing 2*b*, the plungers 36 traverse the upper surfaces of contactors 28 and 30 to cross from one side of the vertical plane containing fulcrum contacts 10 and 12 to the other, thereby rocking the respective contactors clockwise or counterclockwise into engagement with the respective stationary contacts 18*a*, 18*b*, 20*a*, 20*b*. The bias of springs 38 through plungers 36 causes the toggle actuator 32 to assume stable positions on either side of the fulcrum contacts 10, 12. As seen in FIGS. 3 and 4, when the toggle actuator 32 is pivotally moved to dispose the plungers 36 to the left of the fulcrum contacts, the left-hand end of contactor 30 engages stationary contact 18*a* to bridge contacts 18 and 12 while the right-hand end of contactor 28 engages stationary contact 20*b* to bridge contacts 10 and 20. Although not specifically illustrated, it will be understood that when toggle actuator 32 is pivotally moved to dispose plungers 36 to the right of fulcrum contacts 10 and 12, the right-hand end of contactor 30 will engage stationary contact 20*a* while the left-hand end of contactor 28 will engage stationary contact 18*b*, thereby bridging contacts 10 and 18 and contacts 12 and 20. Accordingly, by making the contacts 18*a* and 18*b* at one end of the switch compartments 6 and 8 common and making the contacts 20*a* and 20*b* at the opposite end of the compartments 6 and 8 common, and locating the contacts 18*b*, 20*b* above the rocking contactor 28, a reversing switch function is accomplished internally of the switch without providing cross connect jumpers, either externally or internally.

Figure 7:
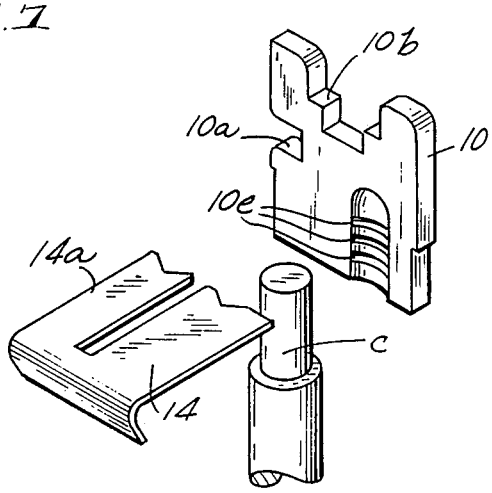
FIG. 7 is an exploded isometric view of a fulcrum contact and wire retaining leaf spring forming an improved press-in wire termination of the switch of this invention.
Figure 9:
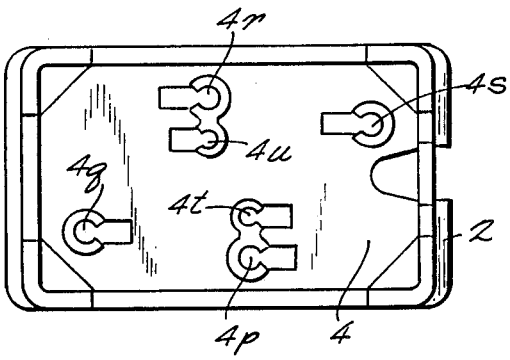
FIG. 9 is a bottom elevational view, drawn to a reduced scale, of the switch of FIG. 1.
Figure 8:
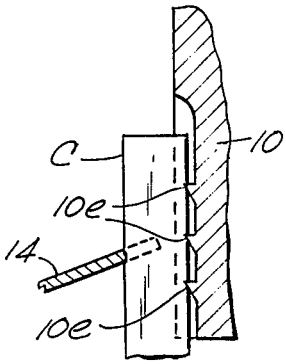
FIG. 8 is a fragmentary sectional view of the wire termination of FIG. 7.

The stationary and fulcrum contact members 10, 12, 18 and 20 of the switch are provided with serrations in one surface thereof in alignment with wire receiving holes 4*p*, 4*q*, 4*r* and 4*s* formed in the bottom of base 4. The formation of the serrations is identical for each of the contact members, and will be described only in conjunction with fulcrum contact 10 illustrated in FIGS. 7 and 8. The serrations 10*e* are formed by stamping a shallow partial cylindrical recess into the surface of contact 10 which is adjacent the end of leaf spring 14. The serrations comprise 3 arcuate tooth-like projections within the recess. The serrations have outwardly directed upper surfaces and angularly disposed lower surfaces to form substantially upwardly directly teeth which permit the insertion of a bared end of a conductor wire C through the hole 4*p* between contact 10 and leaf spring 14 into the respective pocket 4*e* of the switch base. Such insertion deflects the leaf spring 14 upwardly in a well known manner. The end of leaf spring 14 is provided with a shallow V-shaped groove to receive the arcuate shape of the bared end of conductor C. Spring 14 urges the conductor C against the surface of the fulcrum contact 10. The force exerted by spring 14 causes the V-shaped groove thereof to bite into the surface of the conductor C and causes the sharp edges of the serrations 10*e* to bite into the surface of the conductor from the opposite side thereof, thereby restraining the conductor against withdrawal motion. The conductor insertion holes 4*p*, 4*q*, 4*r* and 4*s* in the bottom of base 4 communicate with pockets 4*e*, 4*g*, 4*n* and 4*m*, respectively. Each of these holes are formed in a keyhole shape wherein a tool may be inserted into the rectangular extension of the hole to engage the respective leaf spring retainer and move it inwardly to release the wire conductor when it is desired to remove the conductors.

A second set of conductor insertion holes 4*t* and 4*u*, are provided adjacent holes 4*p* and 4*r*, respectively, for communication with pockets 4*e* and 4*k*, respectively. Holes 4*t* and 4*u* are slightly smaller than holes 4*p* and 4*r* and are in alignment with a leg 14*a* or 16*a* of the bifurcated leaf spring retainers 14 and 16, respectively. These holes 4*t* and 4*u* provide press-in wire terminations for connecting an auxiliary device such as a lamp or the like to the source of power through the common contacts provided by contacts 10 and 12, respectively.

The switch as shown in these drawings may be connected to a source of A.C. input power by connecting power conductors to terminals 10 and 12 through holes 4*p* and 4*r*, respectively. Holes 4*s* and 4*q* are utilized to connect conductors from a load to be controlled by the switch to the output stationary contacts 18 and 20, respectively. The operation of the switch as aforedescribed through the particular contact configurations controls the direction of the current from the contacts 18, 20 to the load.

While the switch of this invention has been described herein in a particular preferred embodiment, it is to be understood that it is susceptible of various modifications without departing from the scope of the appended claims.

I claim:

1. An electrical reversing switch having an insulating housing wherein a pair of switch poles are arranged side-by-side, each pole having a pair of spaced stationary contacts, a fulcrum contact disposed intermediate said stationary contacts, and a rocking contactor supported on said fulcrum contact pivotally movable in opposite directions to cause opposite ends thereof to engage one or the other of said pair of stationary contacts, and an actuator pivotally mounted in said housing having means resiliently engaging an upper surface of said contactor in each pole, said means traversing said upper surface of each said contactor across a plane of the respective fulcrum contact as said actuator is pivoted, said actuator assuming stable positions at either side of said fulcrum contacts wherein said means drives a respective contactor into engagement with a respective one or the other of said stationary contacts, characterized in that:

said stationary contacts in one pole are disposed below the respective contactor and stationary contacts in the other pole are disposed above the respective contactor, said contactor of one switch pole engaging a stationary contact of said one switch pole on one side of said fulcrum contact of said one switch pole, and said contactor of the other switch pole engaging a stationary contact of said other switch pole on an opposite side of said fulcrum contact of said other switch pole when said actuator assumes one of said stable positions.

2. The electrical reversing switch defined in claim 1 wherein said stationary contacts at same sides of respective fulcrum contacts in each pole are electrically joined.

3. The electrical reversing switch defined in claim 1 wherein said stationary contacts at same sides of respective fulcrum contacts in each pole comprise a pair of projections extending from a unitary electrically conductive member.

4. The electrical reversing switch defined in claim 3 wherein said housing comprises slots located transversely to said poles at opposite ends thereof, each of said slots receiving a said unitary conductive member therein.

5. The electrical reversing switch defined in claim 4 wherein said pair of projections extend from said unitary conductive member at different heights, the height of said projections in each respective pole being the same.

6. The electrical reversing switch defined in claim 5 wherein said unitary conductive member comprises positioning means piercing a surface of said housing for securing said member in position.

7. The electrical reversing switch defined in claim 6 wherein said insulating housing comprises a base and a cover telescopically received over said base, said slots being provided in said base and said positioning means comprising a sharp projection on said unitary member directed toward said cover.

8. The electrical reversing switch defined in claim 6 wherein said housing is provided with apertures associated with each fulcrum contact and each unitary conductive member, said apertures locating electric wire conductors inserted therethrough adjacent surfaces on said associated fulcrum contacts and unitary conductive members, and leaf springs entrapped in said housing adjacent each aperture biasing said wire conductor against said surface, each said surface comprising serrations penetrating said wire conductor.

* * * * *